US011925274B2

(12) United States Patent
Lee

(10) Patent No.: US 11,925,274 B2
(45) Date of Patent: Mar. 12, 2024

(54) INFANT CARRIER

(71) Applicant: I-ANGEL CO., LTD., Ansan-si (KR)

(72) Inventor: Jin-Seob Lee, Suwon-si (KR)

(73) Assignee: I-ANGEL CO., LTD., Ansan-si (KR)

( * ) Notice: Subject to any disclaimer, the term of this patent is extended or adjusted under 35 U.S.C. 154(b) by 0 days.

(21) Appl. No.: 17/340,110

(22) Filed: Jun. 7, 2021

(65) Prior Publication Data

US 2021/0289951 A1 Sep. 23, 2021

Related U.S. Application Data

(63) Continuation of application No. PCT/KR2019/009246, filed on Jul. 25, 2019.

(30) Foreign Application Priority Data

Dec. 12, 2018 (KR) ..... 10-2018-0160361

(51) Int. Cl.
*A47D 13/02* (2006.01)

(52) U.S. Cl.
CPC ..... *A47D 13/025* (2013.01)

(58) Field of Classification Search
CPC .... A47D 13/025; A47D 13/02; A47D 13/027; A47D 13/029; A61F 2250/001; A61F 5/022; A61F 5/028
USPC ..... 224/158–161
See application file for complete search history.

(56) References Cited

U.S. PATENT DOCUMENTS

| | | | | |
|---|---|---|---|---|
| 9,655,761 | B2 * | 5/2017 | Joseph | A61F 5/028 |
| 2010/0155446 | A1 * | 6/2010 | Stein | A47D 13/025 224/159 |
| 2014/0135672 | A1 | 5/2014 | Joseph et al. | |

FOREIGN PATENT DOCUMENTS

| | | | |
|---|---|---|---|
| CN | 208017262 | U | 10/2018 |
| EP | 3861890 | A1 | 8/2021 |
| JP | 2-54455 | U | 4/1990 |
| JP | 3143245 | U | 7/2008 |
| JP | 2016-512124 | A | 4/2016 |
| JP | 2018-519906 | A | 7/2018 |
| KR | 10-0250923 | B1 | 4/2000 |
| KR | 10-2017-0095093 | A | 8/2017 |
| KR | 10-1791471 | B1 | 10/2017 |
| WO | 2007/098266 | A2 | 8/2007 |

OTHER PUBLICATIONS

European Search Report of European Patent Application No. 19895951.2 dated Jul. 13, 2022.
Office Action of Japanese Patent Application No. 2021-534322 dated Aug. 5, 2022.

* cited by examiner

*Primary Examiner* — Nathan J Newhouse
*Assistant Examiner* — Matthew T Theis
(74) *Attorney, Agent, or Firm* — Revolution IP, PLLC

(57) ABSTRACT

An infant carrier includes a waist-worn member having a circumferential length capable of wrapping at least a part of a waist of a user, and a tightening unit configured to selectively bring the waist-worn member into close contact with the waist of the user, wherein the tightening unit includes a cable member, a hooking part configured to movably support the cable member, and an adjustment part configured to adjust the circumferential length of the waist-worn member by winding or unwinding the cable member.

9 Claims, 6 Drawing Sheets

INFANT CARRIER

TECHNICAL FIELD

The present disclosure relates to an infant carrier.

BACKGROUND

In general, an infant carrier is suitable for carrying an infant on the user's chest or carrying an infant on the user's back for the sake of convenience and safety when an infant who cannot walk goes out.

In the case of a conventional typical infant carrier, the infant's weight is mostly transmitted to the shoulder of a guardian through a shoulder belt, and the guardian tilts the upper body backward or forward to maintain a balance depending on the posture of holding the infant on the chest or the back. As a result, there is a problem that excessive strain occurs on the backbone of the guardian and the infant carrier is very inconvenient to wear. In particular, as the infant grows, the weight increases. Therefore, there is a problem that an excessive load acts on the user's waist due to the infant's weight when holding an infant who has grown to some extent.

SUMMARY

The embodiments of the present disclosure have been conceived to solve the aforementioned problems of the related art, and provide an infant carrier capable of distributing the infant's load and alleviating the user's body burden.

Furthermore, the embodiments of the present disclosure provide an infant carrier capable of allowing the length of a waist-worn member to be adjusted easily and more precisely than that of the conventional infant carrier.

According to one aspect of the present disclosure, there is provided an infant carrier, including: a waist-worn member provided so as to be worn on a waist of a user and including a first worn part and a second worn part; and a tightening unit provided on the waist-worn member and configured to adjust a circumferential length of the waist-worn member when the waist-worn member is worn on the waist of the user, wherein the tightening unit includes a cable member configured to connect the first worn part and the second worn part, a hooking part configured to movably support the cable member passing therethrough, an adjustment part configured to wind the cable member and adjust the circumferential length of the waist-worn member by selectively unwinding at least a part of the cable member, and a cover selectively connected to the waist-worn member to cover at least a part of the tightening unit, and the cover includes a connection portion configured to be connectable to the waist-worn member, and a waist support portion configured to support the waist of the user between the waist-worn member and the waist of the user.

According to the embodiments of the present disclosure, it is possible to alleviate the body burden of the user of the infant carrier.

Furthermore, it is possible to allow the length of a waist-worn member of the infant carrier to be adjusted easily and more precisely than that of the conventional infant carrier.

DETAILED DESCRIPTION

Figure 1:
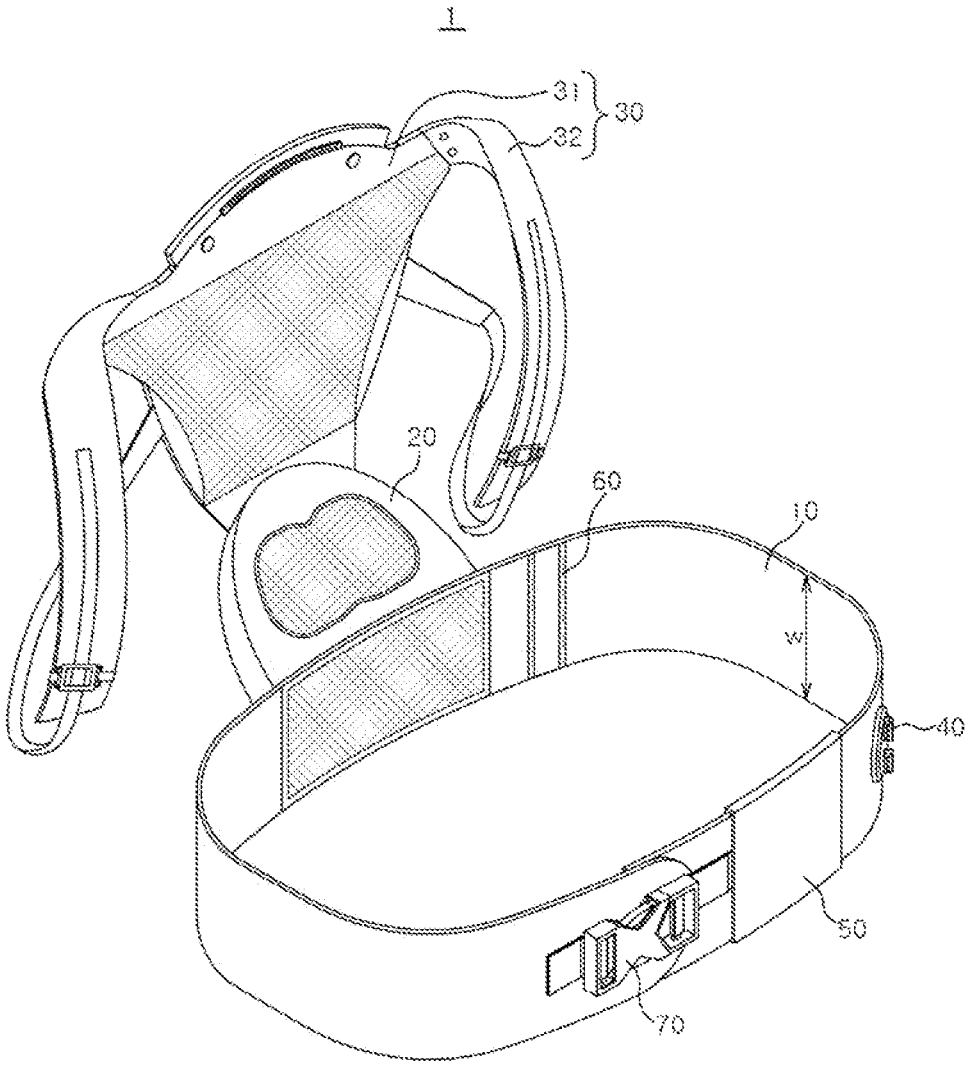
FIG. 1 is a perspective view conceptually showing an infant carrier according to one embodiment of the present disclosure.

Hereinafter, specific embodiments for implementing the spirit of the present disclosure will be described in detail with reference to the drawings.

In addition, in describing the present disclosure, if it is determined that a detailed description of a related known configuration or function may obscure the subject matter of the present disclosure, the detailed description thereof will be omitted.

In addition, when one component is referred to as being 'connected to', 'supported by' or 'in contact with' another component, it should be understood that one component may be directly connected to, supported by or in contact with another component and a further component may exist between one component and another component.

The terms used in the subject specification are only used to describe specific embodiments, and are not intended to limit the present disclosure. Singular expressions include plural expressions unless the context clearly indicates otherwise.

In addition, in the subject specification, expressions such as upper side, lower side, side surface, and the like are defined with reference to the illustration in the drawings. It should be noted that if the direction of the corresponding object is changed, the object may be expressed differently. For the same reason, some components in the accompanying drawings are exaggerated, omitted, or schematically illustrated. The size of each component does not thoroughly reflect the actual size.

In addition, the terms including ordinal numbers such as first and second may be used to describe various components, but the corresponding components are not limited by such terms. These terms are only used for the purpose of distinguishing one component from another.

The meaning of 'comprise' as used in the specification specifies a specific characteristic, region, integer, step, operation, element and/or component, and does not exclude the existence or addition of other specific characteristic, region, integer, step, operation, element, component and/or group.

Hereinafter, a specific configuration of an infant carrier according to one embodiment of the present disclosure will be described with reference to the drawings.

Referring first to FIG. 1, the infant carrier 1 according to one embodiment of the present disclosure may be used to move an infant. A user may fix the infant carrier around the waist, seat an infant on the infant carrier and move the infant. This infant carrier 1 may include a waist-worn member 10, a hip seat 20, a carrier blanket 30, a tightening unit 40, a cover 50, a length selection unit 60, and a connector 70.

The waist-worn member 10 may be formed to cover all or part of the user's waist when the user wears the infant carrier 1. The waist-worn member 10 may include a first worn part 11 and a second worn part 12 connected to each other by a cable member 100 to be described later. In addition, the waist-worn member 10 may be configured to be fastened to the user's waist while being supported by the user's waist. Moreover, the circumferential length of the waist-worn member 10 may be adjusted by the tightening unit 40 and the length selection unit 60. In addition, the waist-worn member 10 may be formed to extend to both sides of the hip seat 20, and may have a belt shape having opposite ends.

The hip seat 20 may support the infant's load. The hip seat 20 may be connected to the outer circumferential surface of the waist-worn member 10 and may support the hips of the infant. The hip seat 20 may include a foam for firmly maintaining its shape and a fabric covering the foam. On the upper side of the hip seat 20, there may be provided a seat member that provides a fluffy feeling when the infant's hips are seated on the hip seat 20. The seat member may be made of a material such as Styrofoam, for example.

When viewed from one side, the lower surface of the hip seat 20 may be formed in a gently curved shape, and the upper surface of the hip seat 20 may be formed in a flat shape so as to inclined upward as it extends away from the user when the hip seat 20 is worn by the user and brought into close contact with the user's body. Accordingly, when the infant is seated on the hip seat 20, the infant's upper body is inclined toward the user's body, thereby providing comfort and stability to the infant.

The carrier blanket 30 can support the infant's body. The carrier blanket 30 may include a support 31 for supporting the back or hips of an infant, and a shoulder strap 32 connected to the support 31 and attached to the shoulder of the user. The shoulder strap 32 may be configured to be adjustable in length.

In the drawings showing the present embodiment, it is shown that the carrier blanket 30 is connected to the hip seat 20 which in turn is connected to the waist-worn member 10. However, in some cases, one of the hip seat 20 and the carrier blanket 30 may be configured to be selectively removable or may be omitted. In addition, when the hip seat 20 is omitted, the carrier blanket 30 is connected to the waist-worn member 10 so that the carrier blanket 30 can support the hips and the back of the infant. When the carrier blanket 30 is omitted, the infant's hips can be seated on the hip seat 20 without the carrier blanket 30.

Figure 2:
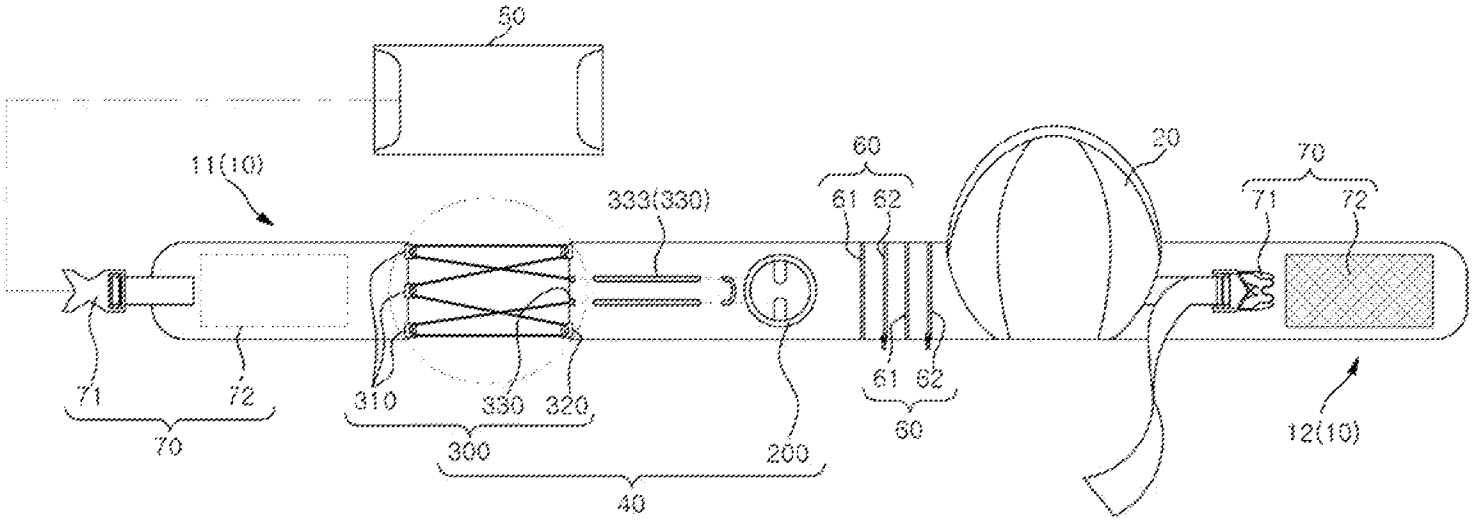
FIG. 2 shows a state in which a cover is removed when a waist-worn member of the infant carrier of FIG. 1 is unfolded.
Figure 3:
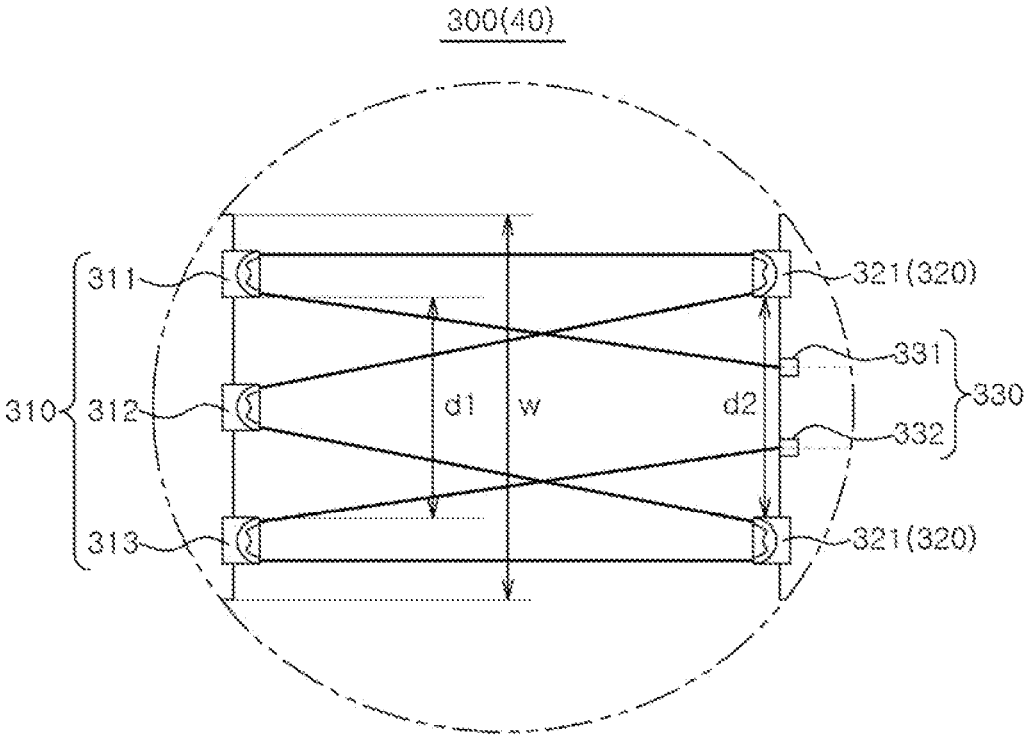
FIG. 3 is an enlarged view of a cable member and hooking parts shown in FIG. 2.

Referring further to FIGS. 2 and 3, the tightening unit 40 may adjust the circumferential length of the waist-worn member 10. In addition, the adjustment of the circumferential length of the waist-worn member 10 may be performed by operating the tightening unit 40 while the user is wearing the infant carrier 1. The tightening unit 40 may include a cable member 100, an adjustment part 200 and a hooking part 300.

One side of the cable member 100 may be connected to the adjustment part 200. The cable member 100 may be wound in the adjustment part 200 by rotating the adjustment part 200. Furthermore, the cable member 100 may extend from the adjustment part 200, may sequentially pass through an end-side cable guide (first cable guide 331), a first hooking arrangement 310, a second hooking arrangement 320 and an end-side cable guide (second cable guide 332), and may extend to the adjustment part 200 again. In addition, the cable member 100 may extend so as to alternately pass through the first hooking arrangement 310 and the second hooking arrangement 320. This cable member 100 may be formed of a wire.

The adjustment part 200 may adjust the circumferential length of the waist-worn member 10 by winding or unwinding the cable member 100. The adjustment part 200 may be disposed on the outer circumferential surface of the waist-worn member 10, and may be disposed closer to the second hooking arrangement 320 than the first hooking arrangement 310 of the hooking part 300. In addition, the adjustment of the circumferential length of the waist-worn member 10 by the adjustment part 200 may be performed even when the user wears the infant carrier 1. The adjustment part 200 is configured to wind the cable member 100 by rotating in one direction (e.g., clockwise) and to unwind the cable member 100 by rotating in the other direction (e.g., counterclockwise).

In addition, the adjustment part 200 may be placed in a locked state or an unlocked state by a stopper (not shown) that can selectively limit rotation of the adjustment part 200 in the other direction. Such a stopper may be disposed inside the adjustment part 200. For example, the stopper may include a groove and a protrusion which are engaged with each other when the adjustment part 200 is in a locked state and which are spaced apart from each other when the adjustment part 200 is in an unlocked state. When in the locked state, the stopper may allow rotation of the adjustment part 200 in one direction to reduce the circumferential length of the waist-worn member 10 of the adjustment part 200, but may limit rotation of the adjustment part 200 in the other direction to increase the circumferential length of the waist-worn member 10 of the adjustment part 200. In addition, when in the unlocked state, the stopper may allow rotation of the adjustment part 200 both in one direction and in the other direction. The stopper can prevent the adjustment part 200 from rotating arbitrarily in the locked state, and can prevent the cable member 100 from being unwound.

The adjustment part 200 may be configured to be selectively movable away from the waist-worn member 10. The adjustment part may be placed in the locked state when the adjustment part 200 is moved in one of the direction away from the waist-worn member 10 and the direction toward the waist-worn member 10 (e.g., in the direction toward the waist-worn member 10), and may be placed in the unlocked state when the adjustment part 200 is moved in the other of the direction away from the waist-worn member 10 and the direction toward the waist-worn member 10 (e.g., in the direction away from the waist-worn member 10).

When the user wants to reduce the circumferential length of the waist-worn member 10, the adjustment part 200 may be placed in the locked state by moving the adjustment part 200 in one of the direction away from the waist-worn member 10 and the direction toward the waist-worn member 10 (e.g., in the direction toward the waist-worn member 10), and the cable member 100 may be wound by rotating the adjustment part 200. As the cable member 100 is wound around the adjustment part 200, the distance between the first hooking arrangement 310 and the second hooking arrangement 320 may be shortened to reduce the circumferential length of the waist-worn member 10.

On the other hand, when the user wants to increase the circumferential length of the waist-worn member 10, the adjustment part 200 may be placed in the unlocked state by moving the adjustment part 200 in the other of the direction away from the waist-worn member 10 and the direction toward the waist-worn member 10 (e.g., in the direction away from the waist-worn member 10), and the cable member 100 may be unwound by rotating the adjustment part 200. As the cable member 100 is unwound from the adjustment part 200, the distance between the first hooking arrangement 310 and the second hooking arrangement 320 may be increased to increase the circumferential length of the waist-worn member 10.

Since the adjustment part 200 adjusts the circumferential length of the waist-worn member 10 by adjusting the winding degree of the cable member 100, it is possible to finely adjust the circumferential length of the waist-worn member 10.

The hooking part 300 may support the cable member 100 in a movable manner. The hooking part 300 may include a first hooking arrangement 310, a second hooking arrangement 320 and a guide part 330.

The first hooking arrangement 310 may guide the cable member 100 and may be formed to allow the cable member 100 to pass therethrough. The first hooking arrangement 310 is disposed on the side of one end of the waist-worn member 10 and may include at least one ring. The first hooking arrangement 310 may be disposed at an end portion of the first worn part 11 on the side of the second worn part 12. In the case where a plurality of rings is provided in the first hooking arrangement 310, the distance between the rings may be set to be smaller than the average width of the waist-worn member 10. For example, the first hooking arrangement 310 may include a first ring 311, a second ring 312 and a third ring 313. The first to third rings 313 may guide the movement of the cable member 100 so that the extension direction of the cable member 100 is changed. The cable member 100 may extend in a direction away from the second hooking arrangement 320, pass through the first to third rings 311, 312 and 313, and then extend in a direction toward the second hooking arrangement 320. The first to third rings 311, 312, and 313 may be sequentially arranged along the width direction of the waist-worn member 10, and may be spaced apart from each other. In addition, as shown in FIG. 3, the distance d1 in the width direction of the waist-worn member 10 between the first ring 311 and the third ring 313 may be smaller than the average width w of the waist-worn member 10.

The second hooking arrangement 320 may guide the cable member 100 and may be formed to allow the cable member 100 to pass therethrough. The second hooking arrangement 320 may be disposed on the side of the other end of the waist-worn member 10 and may include at least one ring. The second hooking arrangement 320 may be disposed at an end of the second worn part 12 on the side of the first worn part 11. In the case where a plurality of rings is provided in the second hooking arrangement 320, the distance between the rings may be set to be smaller than the average width of the waist-worn member 10. For example, the second hooking arrangement 320 may include a fourth ring 321 and a fifth ring 322. The fourth and fifth rings 321 and 322 may guide the movement of the cable member 100 so that the extension direction of the cable member 100 is changed. The fourth ring 321 may be disposed to face the first ring 311, and the fifth ring 322 may be disposed to face the third ring 313. The cable member 100 may extend in a direction away from the first hooking arrangement 310, pass through the fourth and fifth rings 321 and 322, and then extend in a direction toward the first hooking arrangement 310. The fourth and fifth rings 321 and 322 may be arranged along the width direction of the waist-worn member 10 and may be spaced apart from each other. Furthermore, the fourth and fifth rings 321 and 322 may be disposed on both sides of the guide part 330 in the width direction of the waist-worn member 10. In addition, as shown in FIG. 3, the distance d2 in the width direction of the waist-worn member 10 between the fourth ring 321 and the fifth ring 322 may be smaller than the average width w of the waist-worn member 10.

The distance between the first hooking arrangement 310 and the second hooking arrangement 320 may be changed by winding or unwinding the cable member 100. In addition, the first hooking arrangement 310 and the second hooking arrangement 320 are wound with the cable member 100 and are not limited when moving toward each other. Therefore, the cable member 100 may be wound until the first hooking arrangement 310 and the second hooking arrangement 320 make contact with each other. Accordingly, the tightening unit 40 may be configured such that the distance between the first hooking arrangement 310 and the second hooking arrangement 320 is adjustable to a wider extent.

The guide part 330 may guide the cable member 100 extending from the adjustment part 200 toward the first hooking arrangement 310 and the second hooking arrangement 320. The guide part 330 may be arranged at the other end of the waist-worn member 10 provided with the second hooking arrangement 320 (e.g., at the end of the second worn part 12 on the side of the first worn part 11). The guide part 330 may include end-side cable guides 331 and 332 and an intermediate cable guide 333. In addition, the end-side cable guides 331 and 332 may include a first cable guide 331 and a second cable guide 332. The end-side cable guides 331 and 332 may have a hole shape, and may be disposed to face the second ring 312 at the other end of the waist-worn member 10.

The end-side cable guides 331 and 332 may guide the cable member 100 to move in a direction coming out from the other end of the waist-worn member 10 or to move in a direction entering the other end of the waist-worn member 10. The intermediate cable guide 333 may extend from the adjustment part 200 toward the end-side cable guides 331 and 332. The intermediate cable guide 333 may include a plurality of intermediate cable guides, one of which may guide the cable member 100 extending from the adjustment part 200 to the end-side cable guide (the first cable guide 331) and the other of which may guide the cable member 100 extending from the adjustment part 200 to the end-side cable guide (the second cable guide 332).

When the hooking part 300 includes a plurality of rings, the cable member 100 may extend in parallel like a zigzag shape. For example, when the first hooking arrangement 310 includes the first to third rings 311, 312 and 313 and the second hooking arrangement 320 includes the fourth and fifth rings 321 and 322 as described above, the cable member 100 may extend from the adjustment part, may sequentially pass through the end-side cable guide (the first cable guide 331), the first ring 311, the fourth ring 321, the second ring 312, the fifth ring 322, the third ring 313 and the end-side cable guide (the second cable guide 332), and may extend back to the cable guide. Since the cable member 100 extends in parallel in this way, the circumferential length of the waist-worn member 10 can be adjusted more finely by the cable member 100.

In the drawings showing the present embodiment, it is shown that both the first hooking arrangement 310 and the second hooking arrangement 320 are provided. However, as an alternative modification, the second hooking arrangement 320 may be omitted. In this case, the cable member 100 may extend from the adjustment part 200, may sequentially pass through the end-side cable guide (the first cable guide 331), the rings of the first hooking arrangement 310 and the end-side cable guide (the second cable guide 332), and may extend to the adjustment part 200 again.

Figure 4:
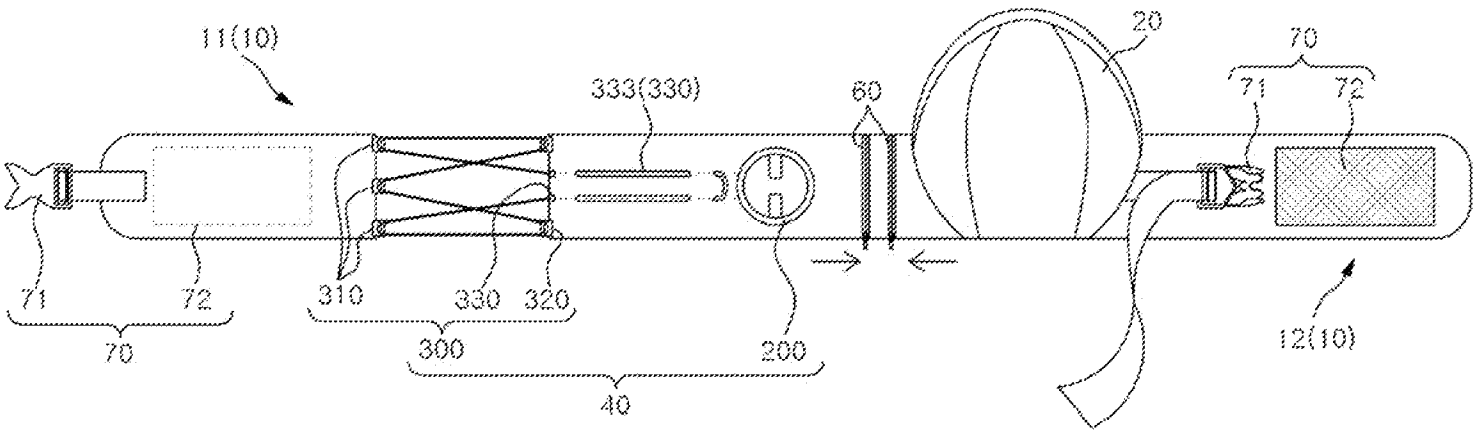
FIG. 4 is a perspective view conceptually showing the cover of the infant carrier shown in FIG. 1.

Referring further to FIG. 4, the cover 50 may cover at least a part of the tightening unit 40. The cover 50 may be selectively connected to the waist-worn member 10. For example, the cover 50 may cover the cable member 100 and the hooking part 300 of the tightening unit 40. Such a cover 50 may be inserted into the waist-worn member 10. The cover 50 may include a waist support portion 51 and a connection portion 52. The connection portion 52 is provided so as to be connected to the waist-worn member 10 and may be formed to penetrate the cover 50 in one direction. The waist support portion 51 may have a shape of a slit having a width substantially equal to the width of the waist-worn member 10. The waist support portion 51 may support the user's waist. The waist support portion 51 may include a shock-absorbing material therein. When the user wears the infant carrier 1, the waist support portion 51 is disposed between the user's waist and the waist-worn member 10 to support the user's waist, thereby providing comfort to the user's waist.

The length selection unit 60 may adjust the circumferential length of the waist-worn member 10. The length selection unit 60 may extend in the width direction and may include a first fastening portion 61 and a second fastening portion 62 that that can be selectively coupled to each other. The first fastening portion 61 and the second fastening portion 62 may be disposed on the outer circumferential surface of the waist wearing member 10. In addition, the first fastening portion 61 and the second fastening portion 62 may extend across the circumferential direction of the waist-worn member 10 and may be disposed parallel to each other. For example, the first fastening portion 61 and the second fastening portion 62 may extend in a direction parallel to the width direction of the waist-worn member 10 so as to be orthogonal to the circumferential direction of the waist-worn member 10.

When the first fastening portion 61 and the second fastening portion 62 are not fastened to each other, they are spaced apart from each other so that the waist-worn member 10 can be unfolded between the first fastening portion 61 and the second fastening portion 62. The user may fasten the first fastening portion 61 and the second fastening portion 62 to each other in order to reduce the circumferential length of the waist-worn member 10. When the first fastening portion 61 and the second fastening portion 62 are fastened to each other, the waist-worn member 10 between the first fastening portion 61 and the second fastening portion 62 is folded. The circumferential length of the waist-worn member 10 may be reduced just as much as the length of the waist-worn member 10 folded by the length selection unit 60. At least one or more length selection units 60 may be provided. The user may adjust the circumferential length of the waist-worn member 10 in advance by fastening the fastening portions of the length selection unit 60 to each other before wearing the infant carrier 1.

The length selection unit 60 may be disposed in a region of the waist-worn member 10 through which the cable member 100 does not pass. In other words, the length selection unit 60 may be disposed so as not to overlap with the cable member 100. For example, the length selection unit 60 may be disposed between the adjustment part 200 and the center of the waist-worn member 10 or between the first hooking arrangement 310 and the center of the waist-worn member 10. Since the length selection unit 60 is disposed in the region through which the cable member does not pass, the user can conveniently operate the length selection unit 60 without interference with the cable member 100.

In the drawings showing the present embodiment, it is shown that the first fastening portion 61 and the second fastening portion 62 are formed of a zipper parts capable of being fastened to each other. However, the spirit of the present disclosure is not limited thereto. The length selection unit 60 may be used to adjust the circumferential length of the waist-worn member 10 in advance before the user wears the infant carrier 1.

The connector 70 may be selectively fastened so that the waist-worn member 10 can be seated on the user's waist while at least partially wrapping around the user's waist. At least a portion of the connector 70 may be provided on the outer periphery of the waist-worn member 10. In addition, the connector 70 may be provided in at least one or more types. For example, the connector 70 may include a buckle 71 and a Velcro 72. The connector 70 is provided as a fastening means between the first worn part 11 and the second worn part 12, and may be configured so that when the waist-worn member 10 wraps around the user's waist, both ends of the connector 70 are connected to each other.

In order to wear the infant carrier 1, the user can wear the waist-worn member 10 on his/her waist by using the length selection unit 60, the tightening unit 40 and the connector 70. Hereinafter, the actions and effects of the infant carrier 1 having the above-described configuration will be described with reference to FIGS. 5 and 6.

Figure 5:
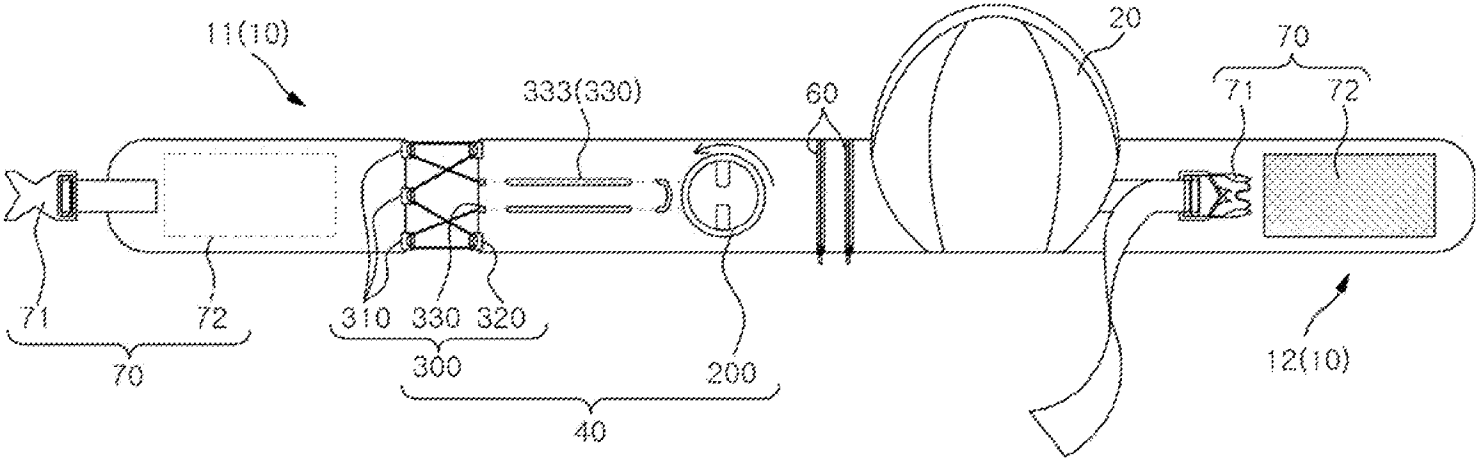
FIG. 5 is a conceptual diagram showing a state in which the circumferential length of the waist-worn member is reduced by fastening a length selection unit of the infant carrier shown in FIG. 1.

Referring first to FIG. 5, the length selection unit 60 is selectively fastened to reduce the circumferential length of the waist-worn member 10. Before wearing the infant carrier 1, the user first sets the circumferential length of the waist-worn member 10 to a degree appropriate to the waist circumference of the user by selectively fastening the length selection unit 60. The length selection unit 60 adjusts the circumferential length of the waist-worn member 10 before the user wears the infant carrier 1, which makes it possible to provide the waist-worn member 10 having circumferential lengths suitable for all users of various body sizes. Therefore, the waist-worn member 10 may be configured so that the waist-worn member 10 can have a length large enough to be worn by a user of an obese body, and the waist-worn member 10 can be comfortably worn by a skinny user without the need to excessively overlap the waist-worn member 10.

A user who has properly adjusted the circumferential length of the waist-worn member 10 through the use of the length selection unit 60 can have the waist-worn member 10 seated on his/her waist by fastening the connector 70. When the waist-worn member 10 comes into close contact with the user's waist over a certain level, the load applied to the user's waist can be reduced and the user can feel that the waist is comfortable. However, there is a limit in bringing the waist-worn member 10 into close contact with his/her waist by the connector 70.

Figure 6:
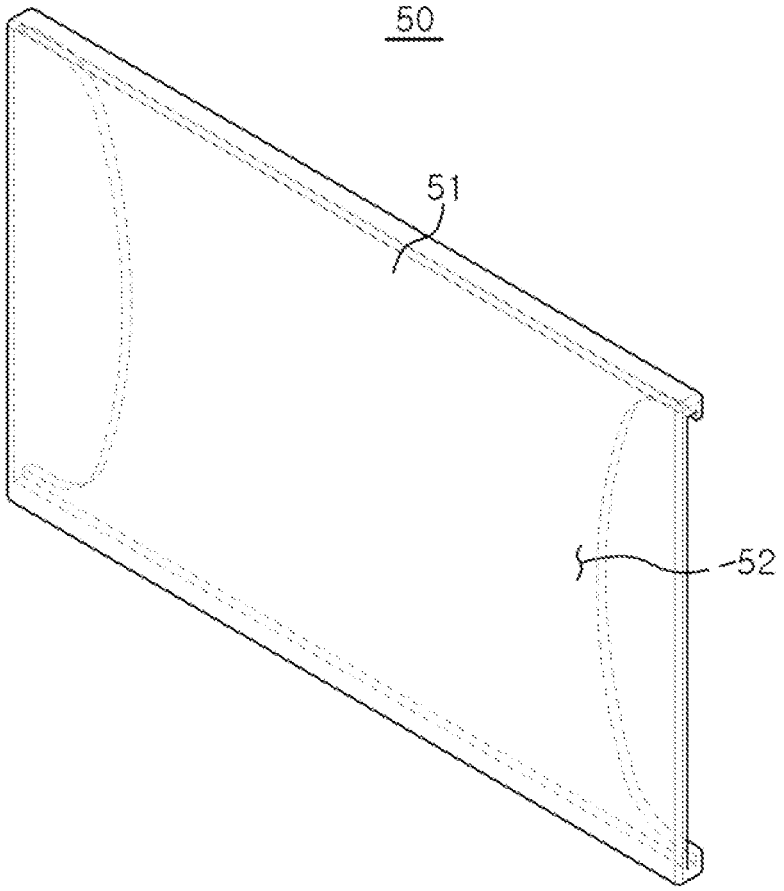
FIG. 6 is a conceptual diagram showing a state in which the circumferential length of the waist-worn member is further reduced by operating a tightening unit of the infant carrier shown in FIG. 5.

Referring next to FIG. 6, when the tightening unit 40 rotates, the circumferential length of the waist-worn member 10 can be precisely reduced. The user can reduce the circumferential length of the waist-worn member 10 through the use of the tightening unit 40 to bring the waist-worn member 10 into close contact with his/her waist. The user may wind the cable member 100 connected to the adjustment part 200 by putting the adjustment part 200 in a locked state and rotating the adjustment part 200 in one direction. As the cable member 100 is wound, the length of the cable member 100 between the first hooking arrangement 310 and the second hooking arrangement 320 is reduced so as to reduce the distance between the first hooking arrangement 310 and the second hooking arrangement 320.

In other words, by merely rotating the adjustment part 200, the user can bring the first hooking arrangement 310 and the second hooking arrangement 320 into close contact with each other, reduce the circumferential length of the waist-worn member 10, and bring the waist-worn member 10 into close contact with to his/her waist. Therefore, the user can easily adjust the circumferential length of the waist-worn member 10 even with a small force, and can more precisely adjust the circumferential length of the waist-worn member 10. When the operation of adjusting the circumferential length of the waist-worn member 10 is completed in this way, the user can seat the infant on the hip seat 20 and/or the carrier blanket 30.

On the other hand, when taking off the infant carrier 1, the user can remove the waist-worn member 10 from his/her waist by operating only the tightening unit 40 and the connector 70 without operating the length selection unit 60. First, in order to unlock the tightening unit 40, the user converts the locked state of the adjustment part 200 into an unlocked state, and rotates the adjustment part 200 in the other direction, so that the cable member 100 connected to the adjustment part 200 can be loosened and unwound. As the cable member 100 is unwound, the distance between the first hooking arrangement 310 and the second hooking arrangement 320 is increased, and the circumferential length of the waist-worn member 10 is increased. Thereafter, the user can remove the waist-worn member 10 from the waist by releasing the connector 70.

While the embodiments of the present disclosure have been described above as specific examples, these embodiments are nothing more than examples. The present disclosure is not limited thereto, and should be construed as having the widest scope in accordance with the basic idea disclosed herein. Those skilled in the art may combine or substitute the disclosed embodiments to implement a pattern of a shape not indicated herein. This also does not depart from the scope of the present disclosure. In addition, those skilled in the art may easily change or modify the disclosed embodiments based on the subject specification. It is apparent that such changes or modifications also belong to the scope of the present disclosure.

What is claimed is:

1. An infant carrier, comprising:

a waist-worn member provided so as to be worn on a waist of a user and including a first worn part and a second worn part; and a tightening unit provided on the waist-worn member and configured to adjust a circumferential length of the waist-worn member when the waist-worn member is worn on the waist of the user, wherein the tightening unit includes a cable member configured to connect the first worn part and the second worn part, a hooking part configured to movably support the cable member passing therethrough, an adjustment part configured to wind the cable member and adjust the circumferential length of the waist-worn member by selectively unwinding at least a part of the cable member, and a cover selectively connected to the waist-worn member to cover at least a part of the tightening unit, wherein the cover includes a connection portion configured to be connectable to the waist-worn member, and a waist support portion configured to support the waist of the user between the waist-worn member and the waist of the user;

a connector disposed at each of the first and second worn parts so as to selectively fasten the waist-worn member;

a hip seat connected to an outer circumferential surface of the waist-worn member and disposed between the adjustment part and the connector; and at least one length selection unit comprising a first fastening portion and a second fastening portion and disposed between the adjustment part and the hip seat on the waist-worn member, wherein, upon a fastened state between the first and second fastening portions, the waist-worn member between the first fastening portion and the second fastening portion is folded, and upon a non-fastened state between the first and second fastening portions, the waist-worn member between the first fastening portion and the second fastening portion is unfolded as the first fastening portion and the second fastening portion are spaced apart from each other, wherein the hooking part includes a first hooking arrangement and a second hooking arrangement, the first hooking arrangement including a first ring, a second ring, and a third ring, wherein the first, the second, and the third rings are arranged in a same column, and the second hooking arrangement including a fourth ring, a fifth ring, and a guide part having a first end-side cable guide having a first hole shape and a second end-side cable guide having a second hole shape, wherein the fourth ring, the fifth ring, the first end-side cable guide, and the second end-side cable guide are arranged in a same column, wherein the cable member passes through the first end-side cable guide, the first ring, the fourth ring, the second ring, the fifth ring, the third ring, and the second end-side cable guide sequentially.

2. The infant carrier of claim 1, wherein the first hooking arrangement is disposed on the waist-worn member so that the cable member passes through the first hooking arrangement, and the guide part is disposed to face the first hooking arrangement so that the cable member passes through the guide part.

3. The infant carrier of claim 2, wherein the guide part is provided at one end of at least one of the first worn part and the second worn part so that the cable member passes through the first and second end-side cable guides, and the cable member configured to extend from the adjustment part and pass through the first and second end-side cable guides and the first hooking arrangement.

4. The infant carrier of claim 3, wherein the guide part further includes an intermediate cable guide provided on the waist-worn member and disposed between the first and second end-side cable guides and the adjustment part so that the cable member passes through the intermediate cable guide.

5. The infant carrier of claim 3, wherein the second hooking arrangement is disposed opposite to the first hooking arrangement so that the cable member passes through the second hooking arrangement, and the cable member extends from the adjustment part and passes through the first and second end-side cable guides, the first hooking arrangement and the second hooking arrangement.

6. The infant carrier of claim 5, wherein the distance between the first and third rings, and between the fourth and fifth rings are set to be smaller than an average width of the waist-worn member.

7. The infant carrier of claim 1, wherein the length selection unit is disposed so as not to overlap with the cable member.

8. The infant carrier of claim 1, wherein the adjustment part is configured to wind the cable member by being rotated in one direction, and further comprising:

a stopper provided inside the adjustment part and configured to selectively limit rotation of the adjustment part in the other direction opposite to the one direction.

9. The infant carrier of claim 1, wherein the waist support portion is formed in a shape of a slit into which at least a part of the waist-worn member is inserted.

* * * * *